United States Patent [19]

Oka et al.

[11] Patent Number: 4,792,775

[45] Date of Patent: Dec. 20, 1988

[54] METHOD FOR THE FORMATION OF OUTLINE IMAGES CORRESPONDING TO THE PERIPHERAL OUTLINES OF DOCUMENT'S IMAGES

[75] Inventors: Tateki Oka, Toyokawa; Naoki Toyoshi, Toyohashi; Tomoaki Yokoyama, Toyokawa, all of Japan

[73] Assignee: Minolta Camera Kabushiki Kaisha, Azuchi, Japan

[21] Appl. No.: 16,717

[22] Filed: Feb. 19, 1987

[30] Foreign Application Priority Data

Feb. 21, 1986 [JP] Japan ..... 61-37829
May 2, 1986 [JP] Japan ..... 61-102588
Sep. 19, 1986 [JP] Japan ..... 61-223246

[51] Int. Cl.[4] ..... G03G 15/00

[52] U.S. Cl. ..... 355/77; 355/3 CH; 355/14 CH; 430/35

[58] Field of Search ..... 355/3 CH, 14 CH, 77; 430/35, 102, 902

[56] References Cited

U.S. PATENT DOCUMENTS 3,967,891 7/1976 Rippstein ..... 355/3 R
4,286,036 8/1981 Hendriksma ..... 355/3 CH X

FOREIGN PATENT DOCUMENTS 51-134635 11/1976 Japan .
54-30833 3/1979 Japan .

*Primary Examiner*—A. C. Prescott
*Assistant Examiner*—Jane Lau
*Attorney, Agent, or Firm*—Wenderoth, Lind and Ponack

[57] ABSTRACT

A method for forming an outline of an image. By this method, at first, an electrostatic latent image bearing member is charged and then irradiated to form an electrostatic latent image. Thereafter, the irradiated member is re-charged with a scorotron charger while applying a voltage to the scorotron grid, the voltage being slightly lower than the surface potential of the image portion of the latent image, and being substantially higher than the background potential of the latent image and being of the same polarity as that of the charging. By this re-charging, the outline portion of the image is given lower potential than the other portion. Then, the outline portion of the image with the lower potential is developed by a reversal development by using a toner charged to a polarity the same as the polarity of charging of the latent image bearing member.

8 Claims, 4 Drawing Sheets

METHOD FOR THE FORMATION OF OUTLINE IMAGES CORRESPONDING TO THE PERIPHERAL OUTLINES OF DOCUMENT'S IMAGES

BACKGROUND OF THE INVENTION

1. Field of the Invention

This invention relates to an outline image forming method which constitutes one of many image forming processes relying upon the electronic photo-copying technology. More specifically, it relates to a method for the formation of outline images corresponding to peripheral outlines along the outside edge of positive images of a document.

2. Description of the Prior Art

Generally speaking, the peripheral outline of an image is, in practice, full of necessary information thereabout and represents sufficiently the characterizing features of the given image, thus playing among others a most important role in the judgement of the latter.

The so-called outline image means that a peripheral outline is picked up from a generally full and positive documentary image and is devoid of intermediate tones or solid representations, thus being most effective for the identification of the practical image and for pattern recognization thereof.

As an example, a complex color image pattern may be desirable to obtain by execution of successive copying operations to form a blank pattern encircled by a color outline, or to prepare a blank pattern for later producing differently colored local image areas contained therein.

It should be noted that the present assignee company has already proposed to an outline image-forming process, wherein, in a mono-component type toner developing method using conductive toner to develop static latent images, process between the material to be subjected to developing and the carrier for the conductive toner, a d.c.-bias voltage is impressed at a medium potential ranged between the maximum and minimum surface potential of said material and having an opposite polarity to the static latent image charge, for extracting only the outline configuration from the latent image on said material to be developed (refer to Japanese Open Patent Specification, unexamined, Sho-51-134635).

It should be further noted, however, that there is a considerable drawback in the above-mentioned prior art improvement. In this proposed process, indeed, the developed marginal outline image is only a negative one, because of the fact that the marginal outline of the static latent image is also negative and the conductive toner will be deposited onto a substantial part of the latent image other than the marginal outline thereof, by virtue of higher potential difference at the substantive part of the latent image on the drum. In practice, however, the wanted marginal outline should preferably be in black and thus positive. Therefore, the thus formed negative outline image must generally be subjected to a further reproducing step using the reverse development principle, which represents naturally a grave and troublesome drawback inherent in the above known process.

SUMMARY OF THE INVENTION

It is, therefore, a main object of the present invention to provide a still further improved method for producing a sharp and clear, blurless outline image.

Another object is to provide a unique outline image forming method in accordance with which the toner is deposited along the outside of the peripheral outline of the latent image corresponding to the positive image of the document and using a normal and regular developing technique, so as to make the outline image visual, and thus to produce a high quality outline image.

Still further objects will become apparent as the description proceeds.

For fulfilment of these and further objects, a preferred mode of the present invention comprises:

a first charging step for applying an electric charge of a predetermined potential level onto the surface of a static latent image carriable member, preferably a photo-sensitive drum;

an exposure step for exposure of a positive image or images onto the surface of said static latent image carriable member upon execution of said first charging step;

a second charging step for recharging the surface of said member after execution of said exposure step and by applying an electric voltage at a lower potential level than that prevailing in the static latent image or images formed in the foregoing exposure step, and having the same polarity as the charge applied in said first charging step, by grid means of a scorotron charger; and a developing step for reversingly developing the static latent image formed in said second charging step using charged toner of the same polarity as in said first charging step.

BRIEF DESCRIPTION OF THE DRAWINGS

In the following description, like parts are designated by like reference numerals throughout the several drawings.

PREFERRED EMBODIMENTS

In the following, a preferred first embodiment of the outline image-forming method of the invention will be set forth with reference to the drawings.

Figure 1:
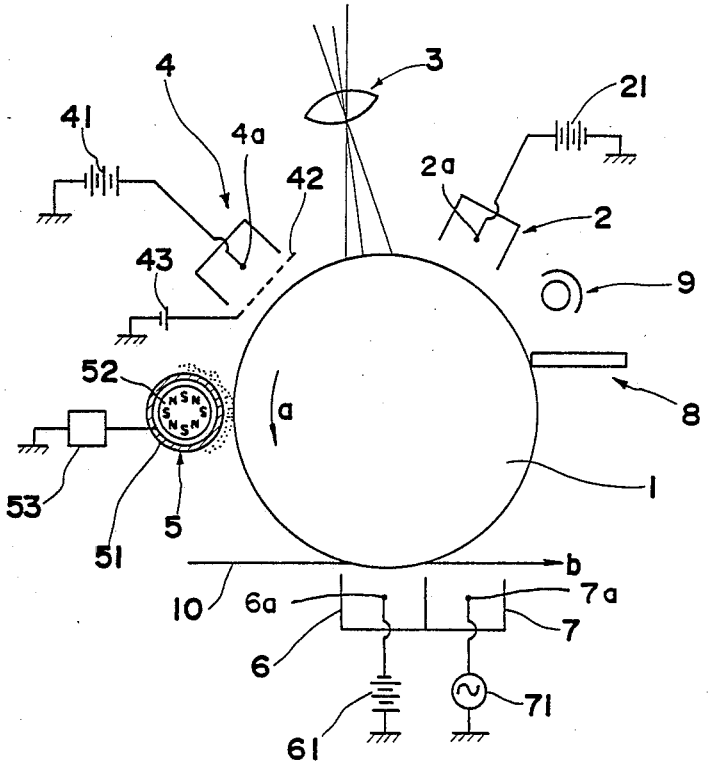
FIG. 1 is a schematic elevation of a first preferred embodiment of an electrostatic photocopier adapted for practicing the inventive method for forming peripheral outline images in a unique manner.

FIG. 1 illustrates only schematically an electronic photocopier adapted for carrying out the process according to the invention.

Numeral 1 designates a photosensitive drum, having an optoelectrical sensitive layer on the cylindrical surface, as is conventional. The rotational direction is shown by a small arrow "a". Several units and apparatuses are provided therearound, as will be more specifically set forth hereinbelow.

Numeral 2 designates a static charger, having a charging wire 2*a* electrically connected to a battery 21, the negative pole thereof being earthed as shown. This charger 2 is adapted for execution of the first charging step, so as to charge the drum surface layer to a certain predetermined static potential level.

Numeral 3 designates only schematically an exposure apparatus adapted for forming static latent images, corresponding to original or document images, onto the drum surface by utilization of a conventional slit exposure system, and comprises an exposure lamp, mirror, lens and the like constituents. In FIG. 1, the exposure apparatus 3 is shown only schematically by a projecting condenser lens.

Numeral 4 designates a second or "scorotron"-charger, which is adapted for execution of a second charging of the surface of drum 1 after the formation of latent images thereon, as was described hereinbefore. The second charger 4 is provided with a charge wire 4*a* connected to a battery 41, the negative pole thereof being earthed as shown. A grid 42 of the second charger 4 is provided which is connected to a separate battery 43, the negative pole thereof being earthed as shown. Charge wire 4*a* is impressed from the battery 41 with a voltage of same polarity as that prevailing at the static charger 2. Grid 42 is impressed from battery 43 with a somewhat lower voltage than the surface potential prevailing at the static latent image area(s) on the drum 1, said voltage having the same polarity as that prevailing at the static charger 2. It should be noted further that the voltage impressed in the grid 42 must be substantially higher than the surface potential prevailing at the background areas of the static latent image area(s) on the drum.

Numeral 5 designates generally a developer comprising a developing sleeve ring 51 or cylinder and a magnet roller 52 fixedly mounted in said ring or cylinder and having a number of alternating N- and S- poles at its periphery. The said developer is capable of operating according to the known magnetic brushing principle. The developing sleeve ring 51 can also operate as developing electrode means, a developing and biasing voltage source 53 being electrically connected to said sleeve. As the developing agent, preferably a mixture of magnetic carrier and insulative toner which have been statically charged with mutually opposite polarities through a frictional charged step. Further, the insulative toner is charged to have the same polarity as that of static charger 2 by the said friction charging step.

If the used insulation toner is non-magnetic, developer sleeve 51 is impressed from voltage source 53 with a developing bias somewhat lower than the grid voltage and of the same polarity as static charger 2.

If desired, however, the insulative toner may be magnetic. In this case, developing sleeve 51 may be impressed with a bias voltage at a higher level than the surface potential prevailing in the non-image or blank area(s) of the static latent image, which surface potential has been elevated in the second charging step.

As an alternative measure, a developing bias on which has been superposed an a.c.-voltage can be used. In the case of magnetic toner, insulative toner only may be used.

Numeral 6 designates a transfer charger, which is so designed and arranged as to impress onto a copy paper 10 being conveyed as shown by a small arrow "b" an electrical field from the rear side of the paper, so as to transfer the toner image(s) on the surface of sensitive drum 1 by the action of developer unit 5. For this purpose, charger 6 is fitted with a charge wire 6*a* which is connected with a battery 61, the positive pole of the latter being earthed as shown. In this way, the charge wire 6*a* is impressed with a voltage with opposite polarity to that of the insulative toner.

Numeral 7 designates a separation charger, which is adapted for impressing an alternating electrical field on the copy paper directly upon execution of said transfer step, for the purpose of removing residual charge therefrom, so as to separate the paper from the surface of drum 1. For this purpose, charge wire 7*a* of the charger 7 is fed with an alternating voltage from a current source 71.

Numeral 8 designates a cleaner unit adapted for removing residual toner from the drum surface by a blade system well known those skilled in the art.

Numeral 9 designates an eraser lamp adapted for removal of residual charges from the drum surface by opto-projection and for making the drum surface ready for execution of the next succeeding photo-copying operation.

In the following, only by way of example, polarities and impressing or impressed voltages of the several chargers and the like, as used in the present embodiment, will be set forth.

(I). When using non-magnetic insulative toner:
static charger (voltage source 21): positive, +5.51 kV
scorotron charger (voltage source 41): positive, +5.5 kV
grid (voltage source 43): postive, +500 V.
distance between grid and drum (dg): 1.5 mm
developing bias (voltage source 53: positive, +400 V.
transfer charger (voltage source 61): negative, −6.0 kV
insulative toner: positive (II). In use of insulative and magnetic toner:
static charger (voltage source 21): positive, +5.5 kV
scorotron charger (voltage source 41): positive, +5.5 kV
grid (voltage source 43): positive, +500 V
distance between grid and drum (dg): 1.5 mm
developing bias (voltage source 53): positive (d.c.), +530 V; a.c., 350 V rms, 1 kHz,
starting potential for development: +450 V
insulative- and magnetic toner: positive It should be noted that above mentioned polarities may all be reversed. Voltage values listed above are naturally given only by way of example and thus may be varied according as the occasion demands.

The method for the formation of the marginal outline image by the use of the foregoing copier machine will be set forth stepwise hereinbelow.

(i). First charging step:

A static charge of a predetermied potential level is applied evenly on the sensitive drum 1 by static charger 2. As a result, the surface potential of drum 1 will be +600 V.

Figure 3:
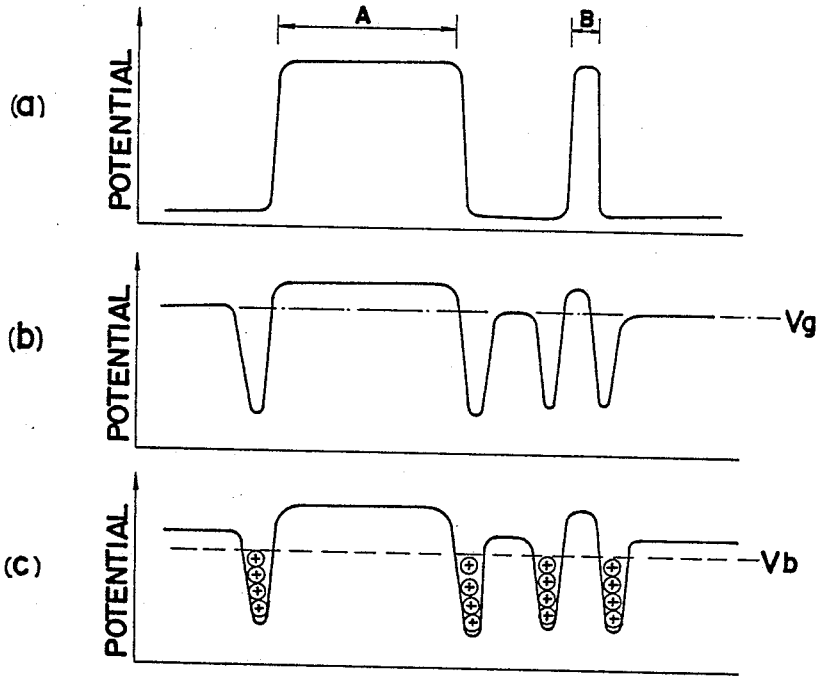
FIGS. 3(*a*), 3(*b*) and 3(*c*) are diagrams showing electrical potentials in the several steps of the method according to the invention.

(ii). Exposure step:

Original document images are exposed onto the drum surface charged to +600 V in the foregoing step. The exposure may be carried out conventionally by the slit exposure means, so as to form the corresponding static latent images thereon. In this case, as shown in FIG. 3(*a*), the charge remaining in image areas "A" and "B" is at the +600 V-potential, while the charge existing in unimaged or background areas other than the image areas is reduced to +100 V or so. Naturally, the document images are positive.

(iii). Second charging step:

A charge of the same polarity as the static latent images is applied by the scorotron charge 4 4 onto the drum surface, on which the latent images have been formed in the foregoing step. In this step, grid 42 is impressed with a voltage of +500 V. The charge of scorotron charger 4 is the same polarity as that in the first charging step, while the voltage applied to the grid 42 is somewhat lower than that in the static latent image areas, +600 V, and of the same polarity as in the first charging step. Additionally, the voltage impressed upon grid 42 is higher than the surface potential, +100 V, in the non-imaged background area portions on the drum.

Figure 2:
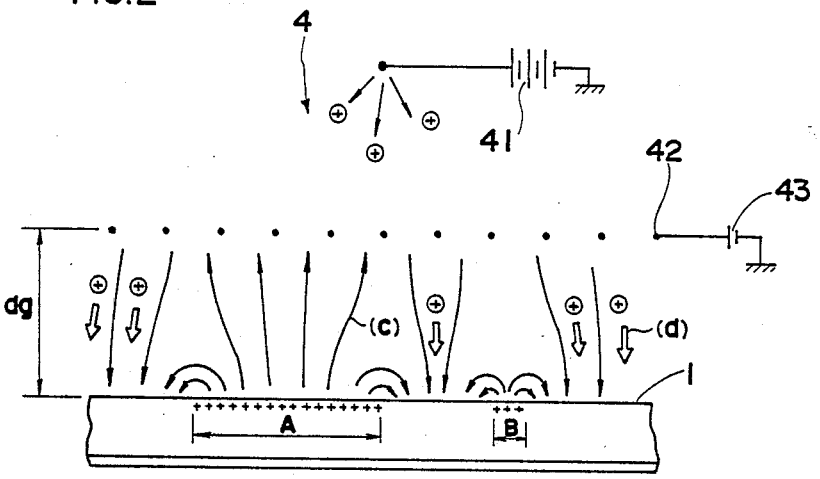
FIG. 2 is a schematic diagram of electric lines of force appearing in the second charging step.

As a result, lines of electrical force as shown by arrows (c) in FIG. 2 are created between the drum surface and the grid, and positive ions issuing from the related charge wire will receive conveying forces along the lines of force. In this case, the lines of force accelerating the positive ions, in proximity of the grid 42 towards the drum surface at 1, are only effective in the background portions other than the peripheral outlines of the image areas "A" and "B". Therefore, the positive ions will arrive exclusively in the background portions defined by and outside the marginal outlines of the images areas (A); (B), as shown by double lined small arrows (d). In this way, the potential of the ion-impinged background areas will be elevated considerably to a value substantially the same as the grid potential, +500 V. In other words, in terms of the corresponding drum surface potential differentials thereby formed, referring to FIG. 3(*b*), the surface potential of the imageless background portions other than the marginal outlines of impinged areas "A" and "B" has been considerably elevated nearly to the grid potential, Vg, +500 V, while the marginal outline portion, having a substantially constant width, keeps a lower potential value, such as +100 V as shown.

As a result, the peripheral outlines of imaged areas "A" and "B" remain in the form of negative static latent images, respectively.

(iv). Developing step:

In the present developing step, the thus formed negative outline images are further subjected to the presently employed developing step by developer unit 5. When the insulative toner is non-magnetic, the developer sleeve 51 is impressed with a developing bias of +400 v, as an example. This developing bias voltage, Vb, is selected to be somewhat lower than the grid voltage, Vg, +500 V, as an example, and lower than the potential of the imaged area "A", and also lower than the potential of the non-iage background area which has been caused to rise to a value substantially equal to the grid voltage, Vg, and having the same polarity as was employed in the first charging step, and, for the purpose of preventing superfluous and fouling toner-deposition, not only in the non-image background areas, but also in the imaged areas, the surface potentials in these areas have been caused to use considerably in the second charging step, as was referred to hereinabove.

On the contrary, when the insulative toner is magnetic, the developing sleeve 51 is impressed with a 350 V a.c., 1 kHz, voltage plus a 530 V voltage, as a developing bias.

This developing bias voltage, Vb, is selected to be somewhat higher than the grid voltage, Vg of 500 V, thus being higher than the potential level of the background area, the latter potential having been elevated precisely or nearly to the grid voltage, Vg. With use of magnetic toner, however, a certain threshold value may exist on account of the very existence of magnetic binding action, and the development will normally start at +450 V or so of the surface potential.

Under this operating condition, there is no fear of superfluous and fouling deposition of the toner on the substantive part of the statically formed latent image areas as well as the imageless background areas, wherein in the former, potential levels have been caused in the second charging step to rise considerably.

Under these operating conditions, and as shown in FIG. 3(*c*), the positively charged insulative toner particles will be deposited onto the lower potential regions on the drum surface, or more specifically, exclusively onto the marginal outline portions around the outside of the imaged areas "A" and "B", whereby a kind of tonered "embroidering" outside edge lines are formed during reversed development. Then, these tonered images are transferrred onto the copy paper 10 upon execution of negative discharge at transfer charger 6 and then subjected to a fixing step in a conventional fixing unit, not shown, to provide corresponding photo-copied images.

(III). A slightly modified example from that set forth hereinbefore, and using non-magnetic insulative toner which is the same as that used in the first embodiment, and in which the operating conditions of the scorotron charger 4 have been changed, will be described. In this case, the following operating conditions have been modified from those as set forth above at (I), although non-magnetic insulative toner has been employed in the foregoing.

scorotron charger (voltage source 41): positive, +6.5 kV
grid (voltage source 43): positive, +400 V
distance between grid and drum (dg): 1.0 mm
developing bias (voltage source 53): positive, 30 430 V.

In this modification, the charging by the scorotron charger 4 is higher than before, and the background potential will rise to 30 450 V or so which is somewhat higher than grid voltage, Vg, except in the peripheral around the outside of the imaged areas "A" and "B". In addition, the developing bias potential, Vb, has been specified to be +430 V which is naturally higher than grid potential Vg, +400 v, but it is lower than the above elevated surface potential +450 v. Therefore, disadvantageous and fouling toner deposition in the static latent image areas can be positively prevented.

Figure 4:
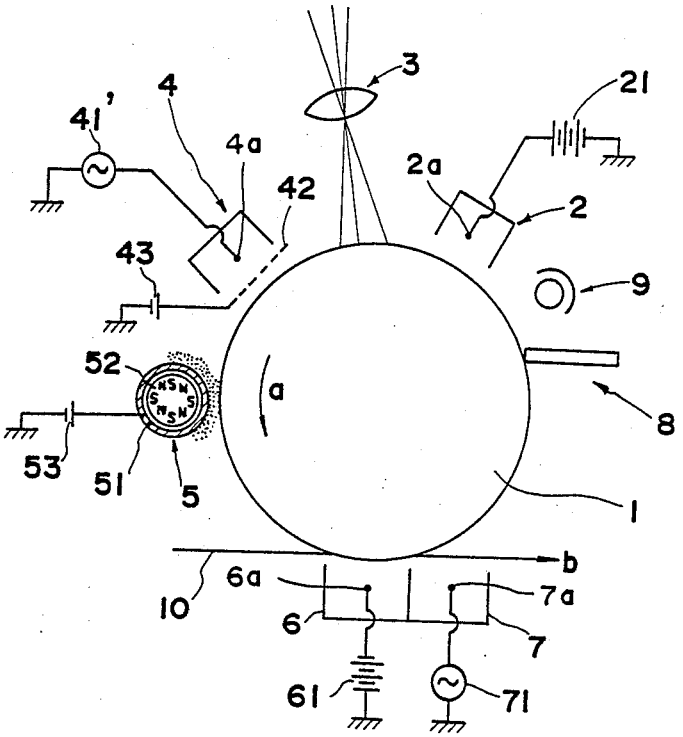
FIG. 4 is a view similar to FIG. 1, showing, however, an apparatus for carrying out a second embodiment of the method of the invention.
Figure 5:
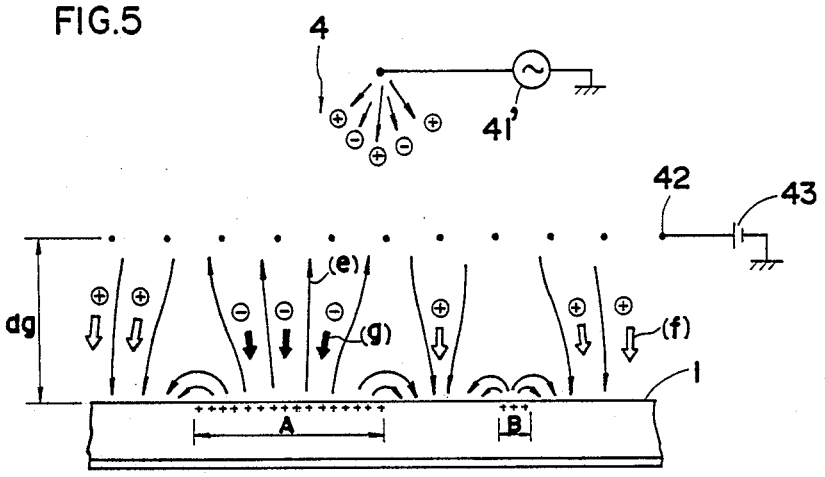
FIG. 5 is a view similar to FIG. 2, showing, however, the lines of force for the apparatus of FIG. 4.

Next, a second embodiment of the invention will be set forth. The difference in the second embodiment from the first is that the scorotron charger 4 is impressed with an a.c.-voltage from voltage source 41' in place of d.c. source 41. FIG. 4 corresponds to FIG. 1; FIG. 5 to FIG. 2; and FIGS. 6(*a*)–6(*c*) to FIGS. 3(*a*)–3(*c*), respectively.

More specifically, scorotron charger 4 carries out a second charging of the drum surface on which the static latent images have been already formed. The charge wire is connected with a.c.-source 41', while grid 42 is connected with voltage source 43. The charge wire is impressed with alternating voltages from the voltage source 41'. On the other hand, grid 42 is impressed from voltage source 43 with a voltage somewhat lower than the surface potential of the imageless background areas and having the same polarity as static charger 2, in the same way as in the first embodiment. It is necessary that the voltage impressed on grid 42 be higher than the surface potential of the static latent image areas, the potential thereat having been lowered considerably under the action of exposure unit 3.

Polarities and voltaages of the several characters and the like constituents in the present second embodiment are similar to those which used in the foregoing first embodiment. However, it should be noted that the voltage of the source 41' for scorotron charger 4 is specified to be a.c.-plus/minus 6.0 kV when the insulative toner is non-magnetic. When magnetic insulative toner is used, the voltage may be the same as above which means a.c.-plus/minus 6.0 kV.

The marginal outline formation process as carried out in the present embodiment will be stepwise set forth hereinbelow.

(i). First charging step:

The surface of sensitive drum 1 is impressed with electrical charge at a predetermined constant level by the action of static charger 2. In the present second embodiment, the drum surface potential is set also to +600 V.

Figure 6:
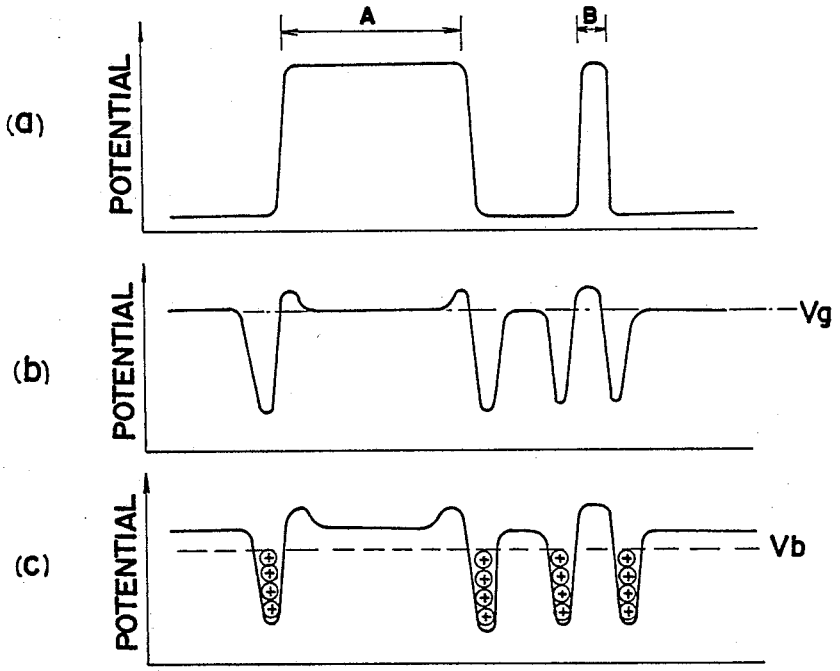
FIGS. 6(*a*), 6(*b*) and 6(*c*) are diagrams similar to those of FIGS. 3(*a*), 3(*b*) and 3(*c*) showing, however, the potentials in the second embodiment of the method of the invention.

(ii). Exposure step:

Then, images from a document are exposed and projected onto the thus charged drum surface by the slit exposure system, for providing the corresponding static latent images. As shown in FIG. 6 at (a), the static charge at the imaged areas "A" and "B" remains at 30 600 V, while that in the imageless background areas will be reduced to +100 V or so under the influence of the light projection. The image areas are positive the same in the foregoing first embodiment.

(iii). Second charging step:

The drum surface with static latent images are formed in the foregoing step is subjected to a recharging step by use of scorotron charger 4, impressed with alternating voltages. At this time, grid 42 is charged with a voltage of +500 V from voltage source 43. This voltage impressed on grid 42 is somewhat lower than the surface potential, +600 V, in the static latent image areas "A" and "B" and substantially higher than the surface potential, 100 V, in the imageless background areas, said voltage being, however, of same polarity as that in the first charging step.

Between the drum surface 1 and the grid 42, lines of electrical force as schematically shown by arrows (e) in FIG. 5 are present. Negative and positive ions issuing from the charge wire impressed with alternating voltages are subjected to conveying forces along these lines of electric force. In this case, the effective lines of force for accelerating positive ions in the proximity of grid 42 towards the drum surface area are only those which exist in the imageless background areas other than on the outside of the peripheral outlines of these images areas "A" and "B". Therefore, these positive ions, as shown by double-lined arrows (f) and in a similar manner as in the foregoing first embodiment, impinge exclusively upon the imageless background areas outside the peripheral zones of these imaged areas "A" and "B", as an example. As a result, the static potential level in these ion-impinged background areas will be caused to rise to a higher level which corresponds substantially to the grid voltage, +500 V.

On the other hand, the negative ions will go ahead, as shown by thickened small arrows (g), towards substantive and effective portions of imaged area "A" for removal of the prevailing, electrical charges thereat, whereby the corresponding potential is lowered to a level nearly equal to the grid voltage, +500 V.

In other words, when more specifically describing the operation in terms of drum surface potential differentials, as shown in FIG. 6(*b*), surface potentials prevailing the imageless background areas, however, other than the outside marginal edge portions of imaged areas "A" and "B", will be caused to rise nearly to the grid voltage; Vg: +500 V.

On the contrary, the outside marginal portions per se, each having a substantially constant width, remain at a certain lower potential level, nearly +100 V.

Further, the potential in the main part of the static latent image, other than the inside marginal zone, will have its value reduced to a lower level, substantially equal to the grid voltage, Vg: +500 V.

At the conclusion of the execution of the present second charging step, the peripheral outlines of these imaged areas "A" and "B" will be formed in the shape of statically negative latent images.

(iv). Developing step:

The static latent images formed in the foregoing second charging step and in the form of negative images, will be subjected now to a developing step under the action of developer unit 5.

The developing conditions and mechanism used in the present step are substantially similar to those which were used in the preceding first embodiment and thus a further description can be without detracting from a full understanding of the present invention.

As a conclusion, it should be noted that the surface potentials, prevailing not only in the latent-imaged areas, but also in the imageless background areas, have been elevated considerably in the second charging step employed in the present invention, for the positive prevention of otherwise conventionally possible superfluous and fouling toner deposition.

In this way, the positively charged insulative toner is reliably deposited at lower potential portions of the photo-sensitive drum surface, or more specifically on the marginal outline portions around the outside of the substantive portions of imaged areas "A" and "B", whereby a kind of sharp and clear "outside-embroidering" toner images are effectively produced upon execution of the reverse development.

It will be clearly understood that according to the inventive principles, lower potential portions of the static latent images formed on the sensitive drum, corresponding to the peripheral outside outline portions have toner exclusively deposited thereon, while other portions consisting of imaged areas, as well as imageless background areas do not have toner thereon, thus providing sharp and clear copied reproduction of marginal outlines of document images, and indeed, with amazing success.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for forming by photocopying an outline of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of recharging the thus irradiated electrostatic latent image bearing member with a scorotron charger having a grid by applying a voltage to the grid with the same polarity as the polarity of the predetermined surface potential of said first step and a value slightly lower than the surface potential of the image portion for raising the potential of the non-image portion; and a fourth step of developing the electrostatic latent image formed in said third step with a reversal development by using a toner charged to a polarity the same as the first step of charging and a voltage lower than the potential to which the non-image portion has been raised by the grid voltage of said third step.

2. A method for forming by photocopying an outline of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of recharging the thus irrdiated electrostatic latent image bearing member with a scorotron charger having a grid by applying a voltage to the grid with the same polarity as the polarity of the predetermined surface potential of said first step and a value slightly lower than the surface potential of the image portion and substantially higher than the surface potential of the non-image portion of the electrostatic latent image formed by said second step for raising the potential of the non-image portion other than around the outside edge of the image portion to a potential approximately equal to the voltage of said grid; and a fourth step of developing the electrostatic latent image formed in said third step with a reversal development by using a toner charged to a polarity the same as the first step of charging and a voltage lower than the potential to which the non-image portion has been raised by the grid voltage of said third step.

3. A method as claimed in claim 2 wherein a voltage of a polarity the same as the polarity of the first step is applied to said scorotron charger.

4. A method as claimed in claim 2 wherein an alternating current voltage is applied to said scorotron for raising the potential of the non-image portion of the electrostatic latent image to a potential approximately equal to the voltage of said grid.

5. A method for forming by photocopying an outline around the outside of an image, said method comprising:

a first step of charging an electrostatic latent image bearing member to a predetermined surface potential and charge polarity;

a second step of irradiating the charged electrostatic latent image bearing member to thereby form a positive electrostatic image thereon having am image portion with a surface potential corresponding to said predetermined surface potential and a non-image portion having a substantially lower surface potential;

a third step of recharging the thus irradiated electrostatic latent image bearing member with a scorotron charger having a grid by applying a voltage to the grid with the same polarity as the polarity of the predetermined surface potential of said first step and a value slightly lower than the surface potential of the image portion and substantially higher than the surface potential of the non-image portion of the electrostatic latent image formed by said second step for raising the potential of the non-image portion other than around the outside of the edge of the image portion to a potential approximately equal to the voltage of said grid; and a fourth step of developing the electrostatic latent image formed in said third step with a reversal development by using a non-magnetic toner charged to a polarity the same as the first step of charging and a voltage slightly lower than the potential to which the non-image portion has been raised by the grid voltage of said third step.

6. A method as claimed in claim 5 wherein a voltage of a polarity the same as the polarity of the first step is applied to said scorotron charger.

7. A method as claimed in claim 5 wherein an alternating current voltage is applied to said scorotron charger for raising the potential of the non-image portion of the electrostatic latent image to a potential approximately equal to the voltage of said grid.

8. A method for forming by photocopying an outline of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of recharging the thus irradiated electrostatic latent image bearing member with a scorotron charger for raising the potential of the non-image portion other than an outline portion around the edge of the image portion for giving the outline portion a potential lower than the potential of the remainder of the image portion; and a fourth step of developing the electrostatic latent image formed in said third step with a reversal development by using a toner charged to a polarity the same as the first step of charging and a voltage lower than the potential of the remainder of the image portion.

* * * * *